US005638705A

United States Patent [19]

Buescher et al.

[11] Patent Number: 5,638,705

[45] Date of Patent: Jun. 17, 1997

[54] PERSONAL WATERCRAFT ANTI-THEFT DEVICE AND A METHOD

[76] Inventors: Michael Sean Buescher; Vicky Catherine Buescher, both of 27705 Falkirk, Mission Viejo, Calif. 92691

[21] Appl. No.: 504,966

[22] Filed: Jul. 20, 1995

[51] Int. Cl.[6] ..... E05B 73/00

[52] U.S. Cl. ..... 70/14; 70/58; 70/164; 70/166; 70/177; 70/180; 137/377; 440/42

[58] Field of Search ..... 70/164, 158–163, 70/165–173, 14, 57, 58, 175–180; 137/377; 440/42

[56] References Cited

U.S. PATENT DOCUMENTS

| | | | |
|---|---|---|---|
| 1,636,641 | 7/1927 | Lewis | 70/164 |
| 3,105,353 | 10/1963 | Schulz | 440/42 X |
| 3,537,283 | 11/1970 | Mross | 70/164 |
| 3,759,076 | 9/1973 | Reese | 70/178 X |
| 3,949,700 | 4/1976 | Baroody | 440/42 X |
| 3,983,726 | 10/1976 | Rausch | 70/164 |
| 4,516,414 | 5/1985 | Woolvin | 70/212 X |
| 5,201,201 | 4/1993 | Sylvester et al. | 70/175 X |
| 5,469,721 | 11/1995 | Pyle | 70/58 X |

*Primary Examiner*—Lloyd A. Gall
*Attorney, Agent, or Firm*—Law Offices of Sandra M. Parker

[57] ABSTRACT

The invention is directed to a method and an anti-theft device for a personal watercraft which is powered by a gasoline engine-driven jet pump. The anti-theft device, having a nozzle cover, a cover holding mender and a cover locking member, is designed to be sealably attached to a jet pump steering diverter nozzle in order to prevent and deter theft of such a watercraft. The jet pump steering diverter nozzle, having an entrance and an exit end, is locked by mounting the nozzle cover to the exit end of the jet steering diverter nozzle, the nozzle cover is engaged in tight contact with the jet steering diverter nozzle with the cover holding member, whereby preventing movement of the nozzle cover in order to restrict the flow of water passing through the jet steering diverter nozzle, and the nozzle cover is locked to the jet steering diverted nozzle in order to prevent unauthorized removal thereof.

19 Claims, 8 Drawing Sheets

PERSONAL WATERCRAFT ANTI-THEFT DEVICE AND A METHOD

BACKGROUND OF THE INVENTION

1. Field of the Invention

The present invention relates to watercraft, and specifically to a personal watercraft which is powered by a gasoline engine-driven jet pump. More particularly, the invention is directed to a method for securing watercraft from theft and a security device for a personal watercraft designed to be sealably attached to the watercraft jet pump steering diverter nozzle in order to prevent and deter theft of such a watercraft.

2. Description of Background Art

In recent years, small personal watercraft have become increasingly popular for both sport and recreational use since they are highly maneuverable and relatively easy to operate. One type of personal watercraft commonly referred to as a jet ski is typically adapted to hold a single person and is designed to be operated in a standing or kneeling position requiring substantial skill by the operator for balance and maneuvering, due to the low stability of the craft especially at lower speeds.

Another type of personal watercraft, commonly referred to as a runabout or wet bike, is designed for seated operation, with one, two or three passengers, and is ridden basically in the same manner as a motorcycle or snowmobile with controls on handlebars that steer a jet pump steering diverter nozzle on the stern. Runabout bikes are able to accommodate riders in motorcycle-style front and back seating positions, and in some models allow side-by-side rider seating. Some models of this type of watercraft are marketed under trademarks Tigershark, Sea-Doo, Jet Ski, Wave Runner, etc.

Generally, these personal watercraft are designed for high performance and run on two stroke motors that power an impeller inside a jet pump, producing a substantial thrust. The use of an impeller inside the jet pump to produce thrust eliminates the hazards associated with use of an exposed propeller found on most engine-driven watercraft. Most jet skis are powered by a gasoline engine-driven jet pump which intakes, pumps and directs a stream of water through an output jet pump steering diverter nozzle at the back of the craft in order to propel the watercraft while floating in the water. The output steering diverter nozzle of the jet pump is pivotably mounted to the underside of the watercraft hull and it can be moved horizontally, thereby allowing the jet to be pivoted in a desired direction to steer the craft.

Personal watercraft employ the jet pump for generating a directed rearward stream of water which provides the forward thrust required to propel the watercraft. The direction of propulsion is controlled by the positioning of the movable jet pump steering diverter nozzle which receives the water stream from the jet pump and directs the flow so as to divide the thrust into the desired directional components. The positioning of the nozzle is affected by steering cables which connect the nozzle to a handlebar, controlled by the operator of the watercraft. The handlebar typically includes a throttle control and an electrical on/off switch.

In most jet skis, steering and engine control is done via a thumb or trigger throttle, linked to the throttle lever by control cabling. The thumb or trigger throttle is mounted on a pair of handlebars pivotable with respect to the longitudinal axis of a handlepole and are connected to a shaft which is mechanically coupled to the jet nozzle, usually by means of cables. When the handlebars of the watercraft are pushed or pulled, the jet propulsion steering diverter nozzle of the watercraft is turned, which causes the force exerted by water propelled therefrom to turn the watercraft in the desired direction.

One of the virtues of personal watercraft is that they are very powerful, since most of these watercraft are designed for competitive racing. However, this is also a serious drawback since they can become dangerous to both their operators as well as to surrounding swimmers and boaters, when they are used for recreation and leisure cruising. A particular problem associated with the above-mentioned personal watercraft, including jet skis, runabout bikes and rigid inflatable jet boats which are driven by pumping a flow of water through a nozzle at the stern of the boat, result from the fact that they can not be secured and, if stolen and used by an unexperienced person, can endanger lives and property. Since the leisure activities may encompass festive occasions or picnics, for which the watercraft is left unattended and without supervision, on a beach or in the water, it is easy for the watercraft to get started and stolen.

Therefore, there exists a need for a personal watercraft safety device which prevents and deters theft of such a watercraft. In addition, personal watercraft represent a substantial investment. Consequently, their owners want to protect their property from theft and possible subsequent damage.

Personal watercraft typically have a safety feature designed to keep the watercraft from getting away from its rider, which either shuts off the engine of the watercraft or causes the watercraft to move circularly, in the event that the rider falls off the watercraft. One illustration of the stopping device used for such a purpose is user interface kill switch, designed for stopping the engine in the watercraft, preferably via an electric wire harnesses. A tether is attached to the wrist or a life jacket of the operator via a lanyard, attached to a safety switch on a handlebar or console. If the rider falls off, the tether pulls the lanyard opening the ignition circuit of the watercraft which then shuts the engine off. However, since the manufacturers usually make one lanyard to fit several models of the watercraft, interchangeably, many unauthorized people have access and may operate a particular watercraft.

Another type of locking device for personal watercraft includes a releasable locking power unit arranged to clamp onto the transom for securing the jet ski by holding the hull configuration. This device puts great stress on the transom since it puts all of the weight at the far end of the boat and it interferes with some uses for the boat. Yet another illustration of a locking device is a releasably attachable means used to lock the watercraft to the dock. It consists of a spike which hooks through a hole on the bow of the watercraft to the dock, in order to retain the watercraft attached to the dock. However, this device can only be used near a dock or another heavy object to be attached to, and can not be used on a beach.

SUMMARY OF THE PRESENT INVENTION

As far as the present inventors know, no prior art devices or methods, including those discussed above, provide a method or means for sealably closing the opening in the output jet pump steering diverter nozzle with a nozzle cover held securely in place, thus restricting water exit and preventing the watercraft from producing the thrust required to propel the watercraft.

It is thus an object of the present invention to provide a method for protection of personal watercraft from theft, designed so that it does not require attachment of the watercraft to a dock or another heavy object and that can be used when the watercraft is laying on the beach.

It is another object of the present invention to provide a security device for a personal watercraft designed to be sealably attached to a jet pump steering diverter nozzle preventing the watercraft from producing the thrust required to propel the watercraft, which deters and virtually eliminates possibility of theft.

Another object of the present invention is to provide an anti-theft assembly for personal watercraft such as jet skis which incorporates a nozzle cover locked to the jet pump steering diverter nozzle for restricting the exit of water through the exit end of the jet pump, thereby stopping the thrust from the jet pump required to propel the watercraft and thus limiting or eliminating the chance of theft.

Yet another object of the invention is to provide a security device designed to fit the particular make and model of a desired personal watercraft.

Another objective of the present invention is to provide a method and an anti-theft device adaptable to a variety of personal watercraft make and models, including jet skis, runabout bikes and rigid inflatable jet boats driven by pumping a flow of water through a nozzle at the stern of the boat.

Still another objective of the present invention is to provide an anti-theft device for personal watercraft preventing use by an unexperienced person who would otherwise be in a position to endanger lives and property.

Therefore, one embodiment of the present invention encompasses a method for preventing theft of a personal watercraft by locking a jet pump steering diverter nozzle, having an entrance end and an exit end, thus preventing the watercraft from producing the thrust required to propel the watercraft. The method includes the following steps: mounting a nozzle cover to the exit end of the jet steering diverter nozzle, engaging the nozzle cover in tight contact with the jet steering diverter nozzle, whereby preventing movement of the nozzle cover in order to restrict the flow of water passing through the jet steering diverter nozzle, and then locking the nozzle cover to the jet steering diverter nozzle in order to prevent unauthorized removal thereof.

Another embodiment of the present invention is an anti-theft device for mounting on a watercraft jet pump steering diverter nozzle. The steering diverter nozzle has an entrance end, an exit end, a generally cylindrical inner surface flaring outwardly from the exit end to the entrance end, a horizontal axis, and a pivotable mounting boss attached at the entrance end, wherein the pivotable mounting boss has larger inside cross-sectional diameter than any inside cross-sectional diameter of the inner surface of the steering diverter nozzle.

The anti-theft device has a nozzle cover adapted to be attached to the exit end of the steering diverter nozzle and at least one cover engaging means for engaging in tight contact the nozzle cover to the steering diverter nozzle, whereby preventing movement of the nozzle cover in order to restrict the flow of water passing through the steering diverter nozzle.

The cover engaging means comprises at least one cover holding member for joining the nozzle cover at approximately right angle for supporting the nozzle cover in a vertical orientation, wherein the cover holding member is generally horizontal. The cover holding member is extending from the nozzle cover into the inner surface of the steering diverter nozzle and is being directed toward the pivotable mounting boss of the steering diverter nozzle.

A cover locking member is utilized for keeping the nozzle cover engaged with the steering diverter nozzle. The cover holding member is elongated and having a top end, a bottom end, a locking opening at a predetermined length from the top end of the cover holding member for insertion and attachment of the cover locking member, and a latching member at the bottom end of the cover holding member, wherein the latching member is outwardly extending for communicating with the steering diverter nozzle, whereby latching the nozzle cover onto the steering diverter nozzle when the cover holding member is extending from the nozzle cover and the cover locking member is locked.

The features of the present invention can be best understood together with further objects and advantages by reference to the following description, taken in connection with the accompanying drawings, wherein like numerals indicate like parts.

DESCRIPTION OF THE PREFERRED EMBODIMENTS

The following specification taken in conjunction with the drawings sets forth the preferred embodiments of the present invention. The embodiments of the invention disclosed herein are the best modes contemplated by the inventors for carrying out their invention in a commercial environment, although it should be understood that various modifications can be accomplished within the parameters of the present invention.

It should be understood by those skilled in the art that the preferred embodiments of the invention are not limited and need not necessarily be used for jet skis, described herein for illustrative purposes only. The security device and the method for securing personal watercraft is designed for any personal watercraft using jet pump which encompasses jet skis, runabout bikes, jet boats and the like. The invention may be embodied in various watercraft jet steering diverter nozzle constructions and encompasses various engaging means with the jet steering diverter nozzle.

As is well known in the art, a jet ski includes a hull and a jet propulsion unit compartment covered by a hood and seat assembly. The jet propulsion unit contains a water intake, and an internal combustion engine which drives a jet pump having a rearward directed, horizontally pivotable, water output jet steering diverter nozzle, all contained in one integral, water-tight unit.

Figure 1:
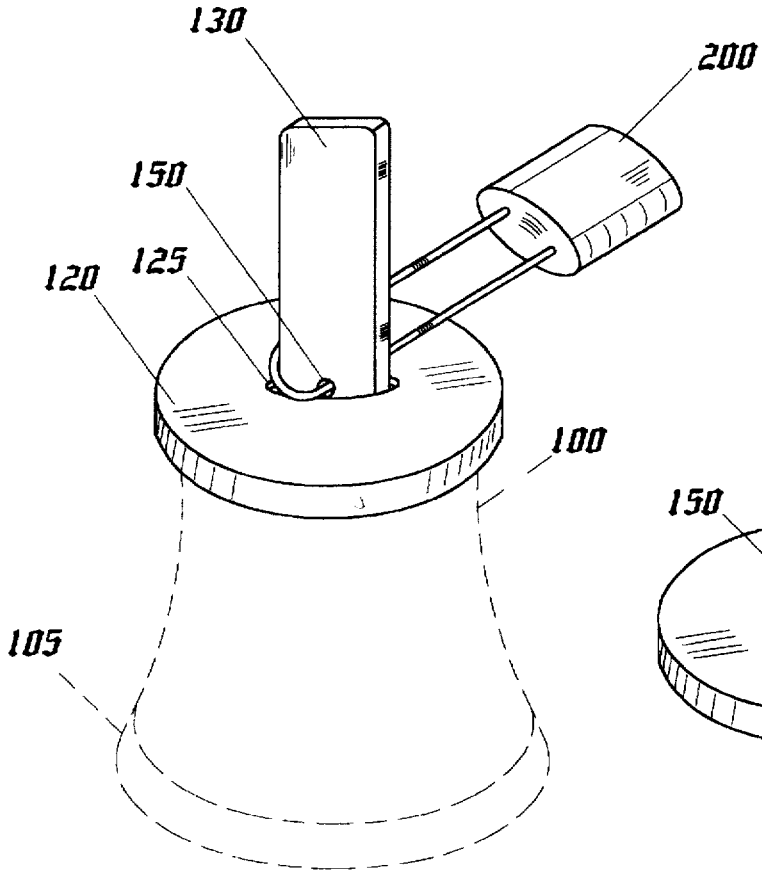
FIG. 1 is a perspective view showing a jet steering diverter nozzle in phantom, and top and right side of a security device, according to the first embodiment of security device of the present invention.

A jet steering diverter nozzle, shown in phantom in perspective view in FIG. 1 and indicated generally by reference character 100, has a generally cylindrical shape which flares outwardly from the water exit end to the water entrance end, and a generally cylindrical inner surface.

A pivotable mounting boss 105 fixedly attached at the entrance end of the jet steering diverter nozzle 100 and provided with means for attachment to a jet pump (not shown), has larger inside cross-sectional diameter than any inside cross-sectional diameter of the inner surface of the steering diverter nozzle 100. The inner surface of the jet steering diverter nozzle 100 forms a water stream so that water expelled from the jet steering diverter nozzle 100 provides a desired forward thrust thereby propelling the watercraft in the desired direction.

The construction of the personal watercraft and the jet steering diverter nozzle 100 is well known in the art and may be considered to be conventional. The personal watercraft, as thus far described, forms no part of the invention but rather the environment in which the invention can be practiced.

Figure 5:
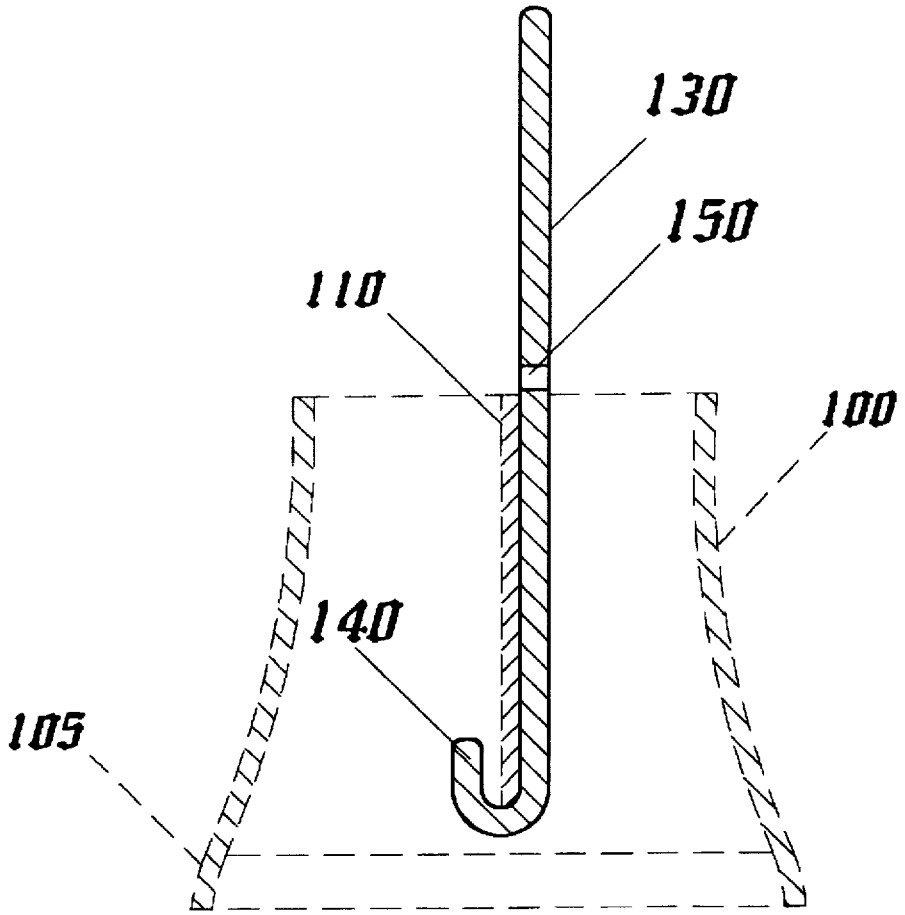
FIG. 5 is a cross-sectional view taken along line 5—5 of FIG. 4, showing mounting of the first embodiment of security device of the present invention.
Figure 4:
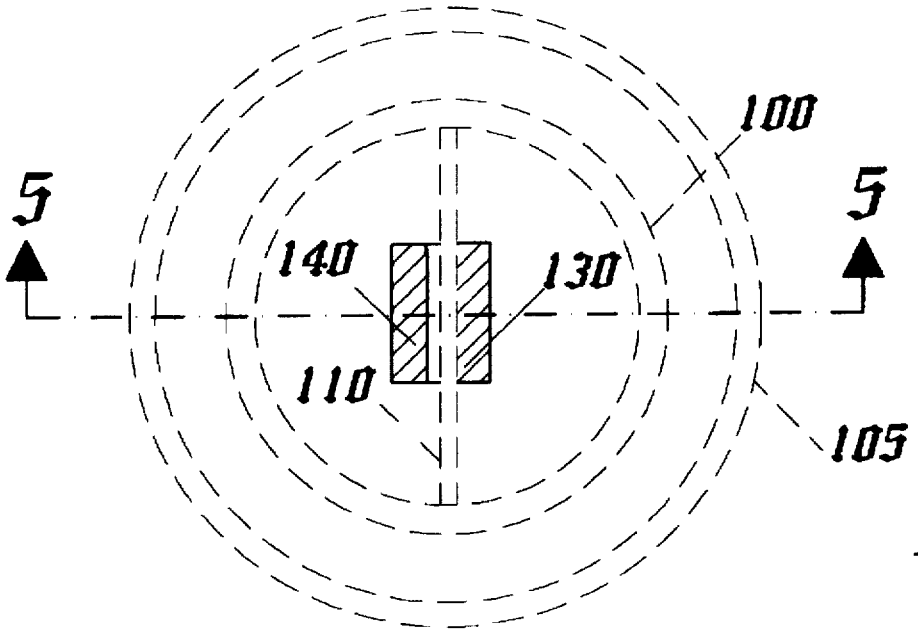
FIG. 4 is a top plan view showing the jet steering diverter nozzle in phantom, and a top plan view of the first embodiment of security device of the present invention.
Figure 8:
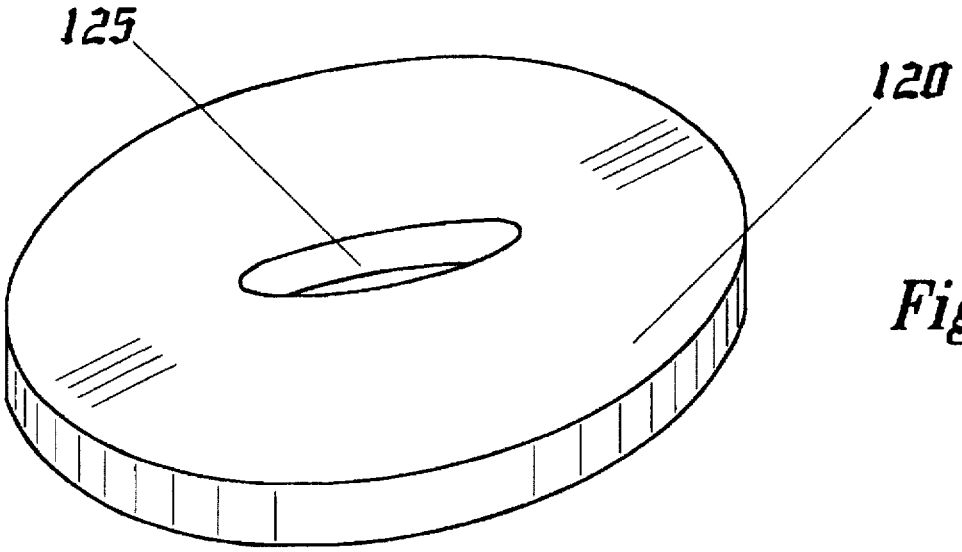
FIG. 8 is a perspective view of a nozzle cover element of the first embodiment of the present invention.

As shown best in FIG. 5, the jet steering diverter nozzle 100 can have a water separator 110, also known as a vertical vane, which generally has a rectangular cross-sectional shape, is positioned inside and bisects the radial plane of the jet steering diverter nozzle 100. In the alternative, some models of the jet steering diverter nozzle 100 can be manufactured without the water separator 110, as shown in FIG. 14.

Figure 14:
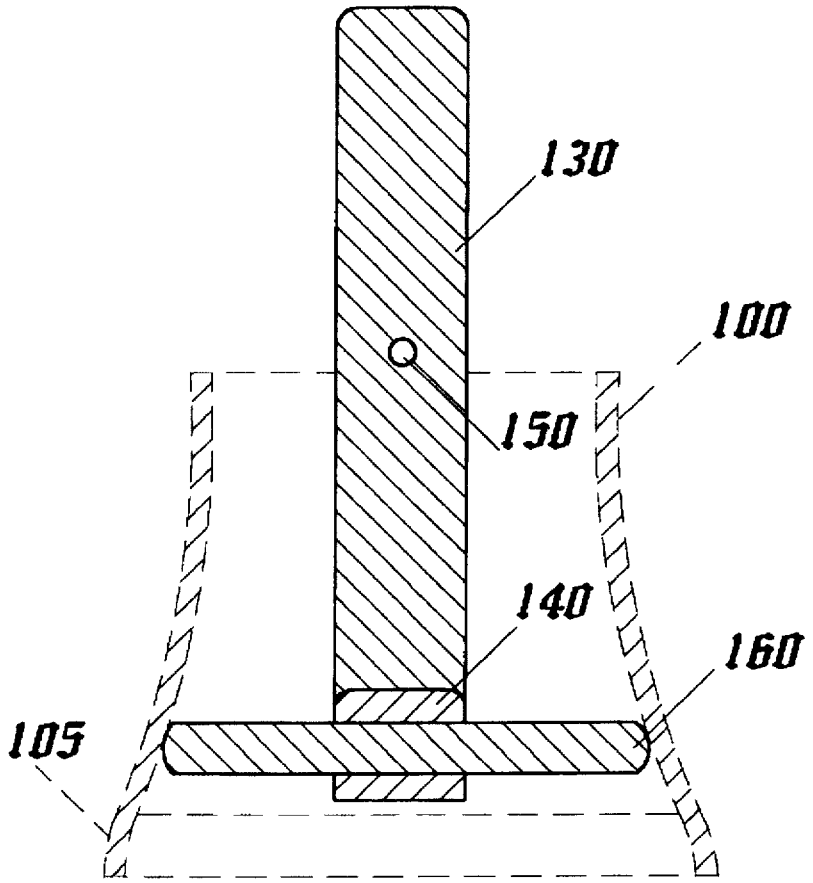
FIG. 14 is a cross-sectional view taken along line 14—14 of FIG. 13, showing mounting of the second embodiment of security device.

Therefore, in this invention, two embodiments of the security device of the present invention are presented in FIGS. 2–10 and FIGS. 11–19, each adapted for a different model of the jet steering diverter nozzle 100, as presented in FIGS. 5 and 14. Each embodiment of the present invention includes a nozzle cover 120, a cover holding member 130 and a cover locking member 200, as illustrated in FIG. 1.

Another embodiment of the present invention encompasses a method for preventing theft of a personal watercraft by locking a jet pump steering diverter nozzle 100, having an entrance end and an exit end, thus preventing the watercraft from producing the thrust required to propel the watercraft. The method includes the following steps:

mounting a nozzle cover 120 to the exit end of the jet steering diverter nozzle 100;

engaging the nozzle cover 120 in tight contact with the jet steering diverter nozzle 100, whereby preventing movement of the nozzle cover 120 in order to restrict the flow of water passing through the jet steering diverter nozzle 100; and locking the nozzle cover 120 to the jet steering diverter nozzle 100 in order to prevent unauthorized removal thereof.

The nozzle cover 120 of the first embodiment of the security device of the present invention, as shown in FIGS. 8–10 and FIGS. 17–19, is round in shape and sturdy, and preferably made of metal. A nozzle cover recess 125 is elongated and cut through the nozzle cover 120 approximately in the middle of the round surface of the nozzle cover 120, in order to accept the cover holding member 130, although the cover holding member 130 can be attached to the nozzle cover 120 by some alternative means.

Figure 9:
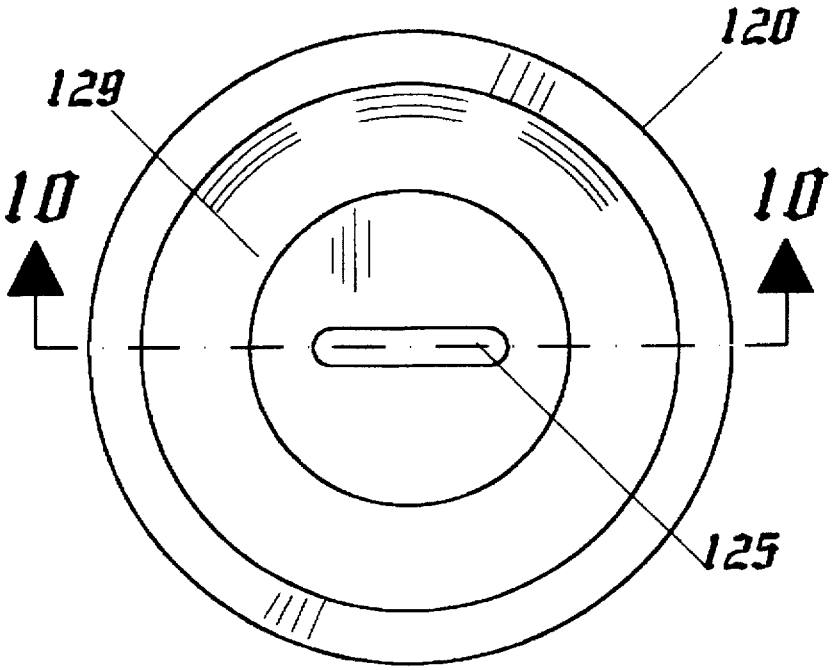
FIG. 9 is a bottom plan view of the nozzle cover element of the first embodiment of the present invention.
Figure 10:
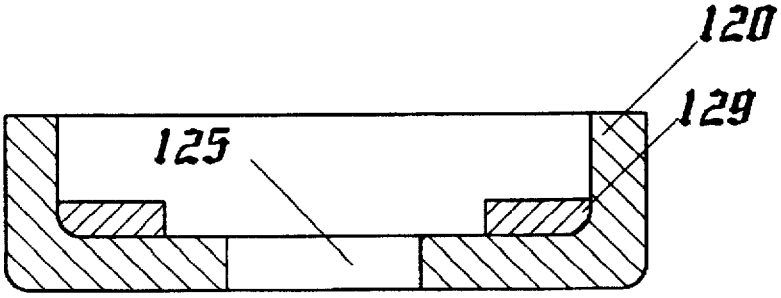
FIG. 10 is a cross-sectional view taken along line 10—10 of FIG. 9.
Figure 18:
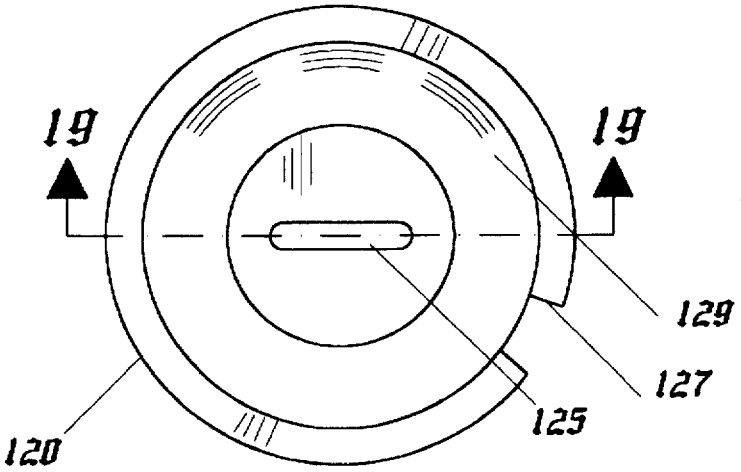
FIG. 18 is a bottom plan view of the nozzle cover element of the second embodiment of the present invention.

In the preferred embodiment of the present invention, the nozzle cover 120 has an elastic circular seal member 129 formed, sized and configured to fit snugly around the periphery of the circular undersurface of the nozzle cover 120, as shown in FIGS. 9 and 18. The nozzle cover 120 and the seal member 129 are designed to contact the exit end of the jet steering diverter nozzle 100 and tightly engage with it when the cover locking member 200 is inserted through the cover holding member 130, described below.

The cover locking member 200, represented in preferred embodiment shown in FIG. 1 by a padlock, holds the security device of the invention in place, at the exit end of the jet steering diverter nozzle 100, and keeps it locked to it. Resilient seal member 129 seals the opening in the exit end of the jet steering diverter nozzle 100, thus reducing the chance of water leakage when the security device is in place. The seal member 129 is made of rubber or other elastic material and, as shown in FIGS. 9 and 18, it has a shape corresponding to the circular undersurface of the nozzle cover 120. It should be noted, however, that the invention can also be used without the seal member 129.

The cover holding member 130 is utilized for joining the nozzle cover 120 at approximately right angle for supporting said nozzle cover 120 in a vertical orientation, wherein said cover holding member 130 is generally horizontal. It is extending from the nozzle cover 120 into the inner surface of the steering diverter nozzle 100 and being directed toward said pivotable mounting boss 105 of the steering diverter nozzle 100.

Figure 2:
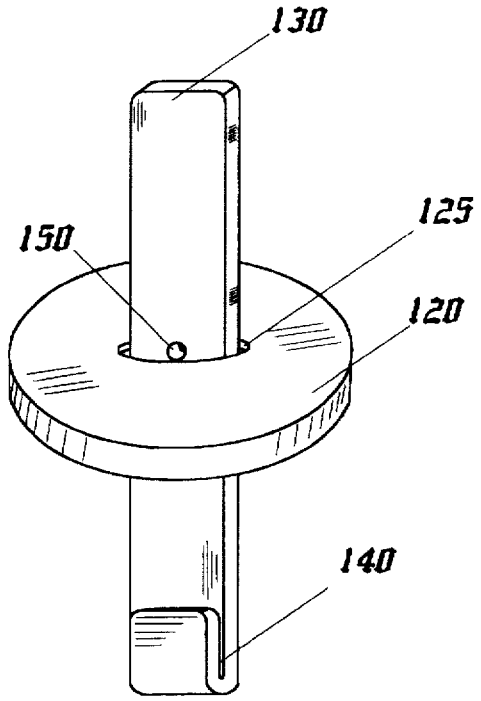
FIG. 2 is a perspective view of the security device according to the first embodiment of security device of the present invention.
Figure 6:
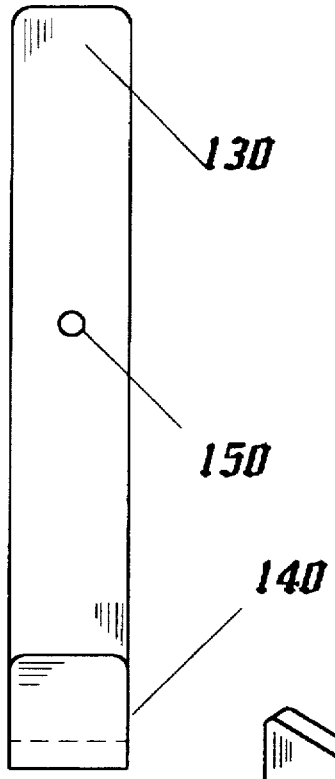
FIG. 6 is a front elevational view of a cover holding member of the first embodiment of the present invention.
Figure 7:
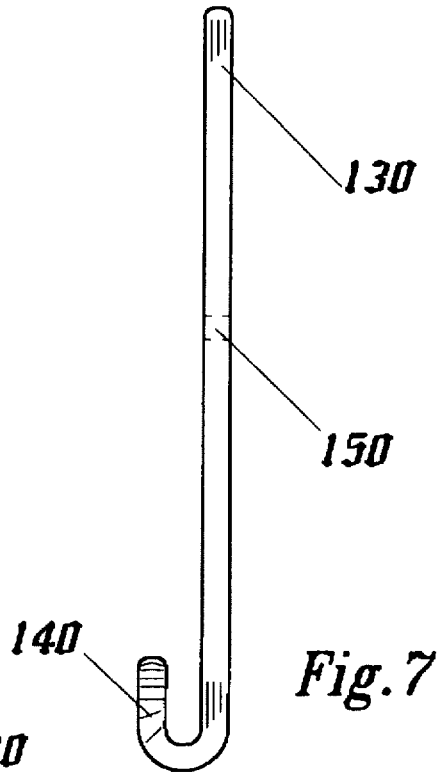
FIG. 7 is a side elevational view of the cover holding member of the first embodiment of the present invention.
Figure 3:
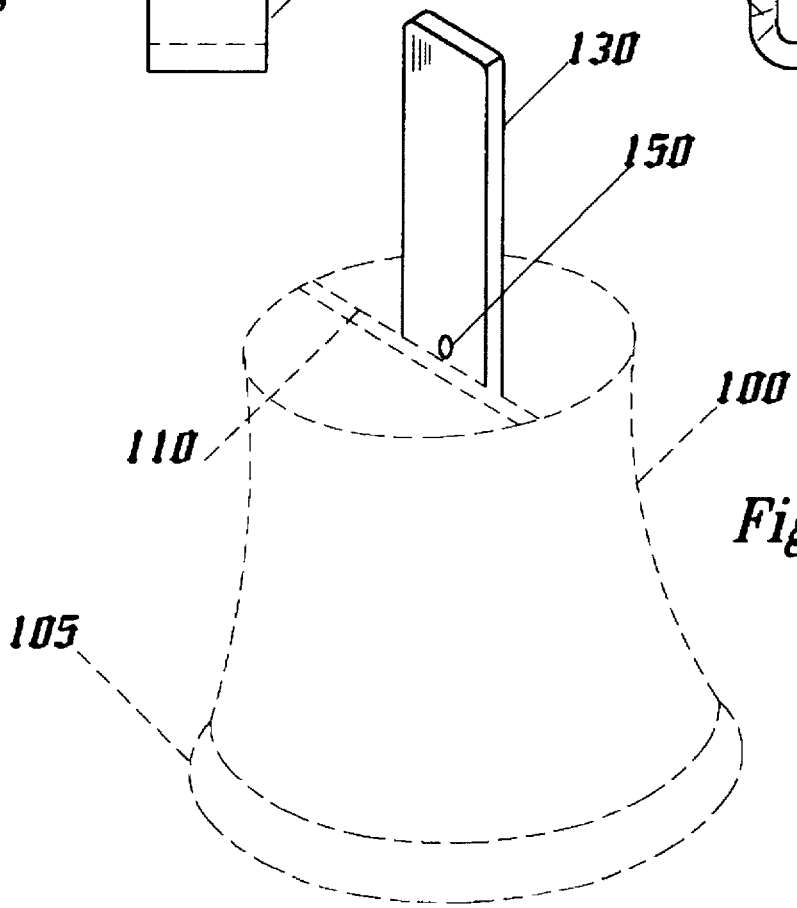
FIG. 3 is a perspective view showing the jet steering diverter nozzle in phantom, and top side of the first embodiment of security device of the present invention.

The cover holding member 130 of the first embodiment of the invention, presented in FIGS. 2–7, is an elongated element with an approximately rectangular cross-section. However, it could have different shapes and even consist of several members. In the preferred embodiment, at its bottom end the cover holding member 130 has a latching flange lip 140 substantially in the shape of an inverted U (as shown in FIGS. 2, 5 and 7). On its top end the cover holding member 130 has a locking opening 150 to accept the cover locking member 200. Cover holding member 130 is made attachable to the water separator 110 of the conventional jet steering diverter nozzle 100. The cover holding member latching flange lip 140 is designed to catch and hold onto the water separator 110 within the jet steering diverter nozzle 100.

when the cover holding member 130 is pulled up through the nozzle cover recess 125 and strengthened in order to accept the nozzle cover 120.

In the preferred embodiments of the present invention, the cover holding member 130 and the cover locking member 200, inserted through the locking opening 150 in the cover holding member 130, engage with nozzle cover 120, in order to prevent movement of said nozzle cover 120 away from the exit end of the jet steering diverter nozzle 100.

The cover locking member 200 is interconnected with the cover holding member 130 in such a manner so as to prevent the nozzle cover 120 to be pulled upwardly from the exit end of the jet steering diverter nozzle 100 or cover holding member 130 to be pushed downwardly or pivotally, thereby preventing water from exiting the jet pump through its exit end and thus preventing the propelling of the watercraft. The locking opening 150, therefore, is designed and cut as low as possible on the top end of the cover holding member 130 for the cover locking member 200 to be positioned immediately above the nozzle cover 120, when the cover holding member 130 and the nozzle cover 120 are in place.

The security device of the present invention is simple in construction and easy to insert and maintain. When the watercraft needs to be left unattended and security is needed, the cover holding member 130 is inserted into the jet steering diverter nozzle 100, the cover holding member 130 is pivoted until the latching flange lip 140 attaches itself to the water separator 110 and assumes a fully raised position. The nozzle cover 120 is then placed over the cover holding member 130, which passes through the nozzle cover recess 125. The nozzle cover 120 is secured through the locking opening 150 in the cover holding member 130, by means of the cover locking member 200, as shown in FIG. 1.

Figure 11:
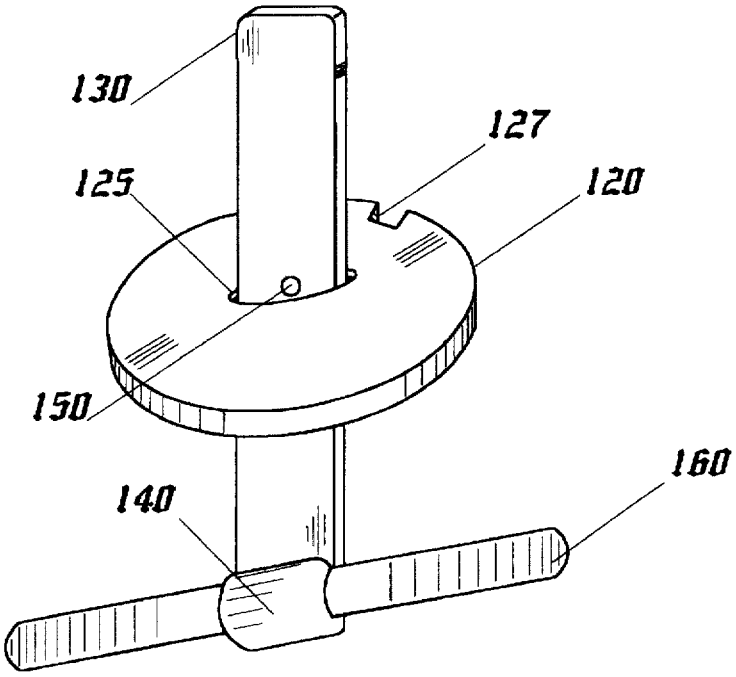
FIG. 11 is a perspective view of a security device according to the second embodiment of the present invention.
Figure 12:
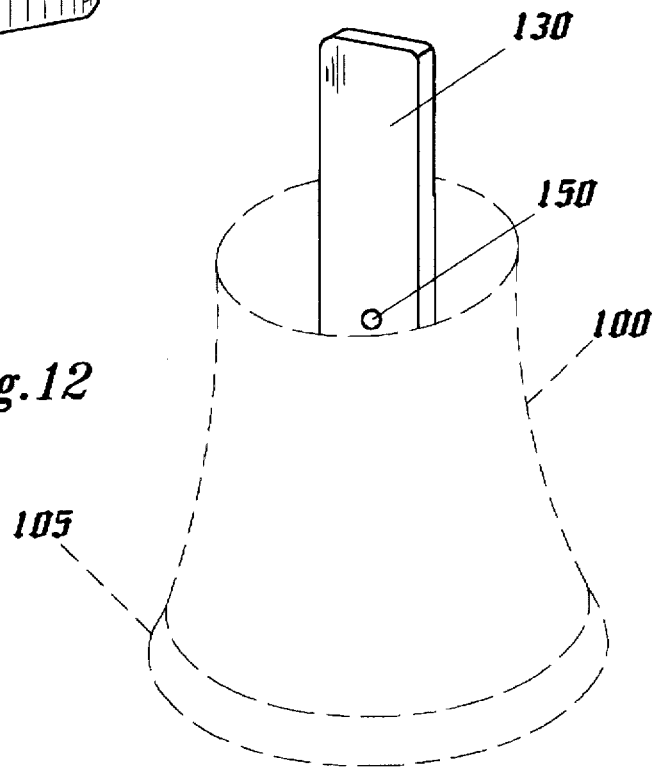
FIG. 12 is a perspective view showing a jet steering diverter nozzle in phantom, and top side of the second embodiment of the security device of the present invention.
Figure 13:
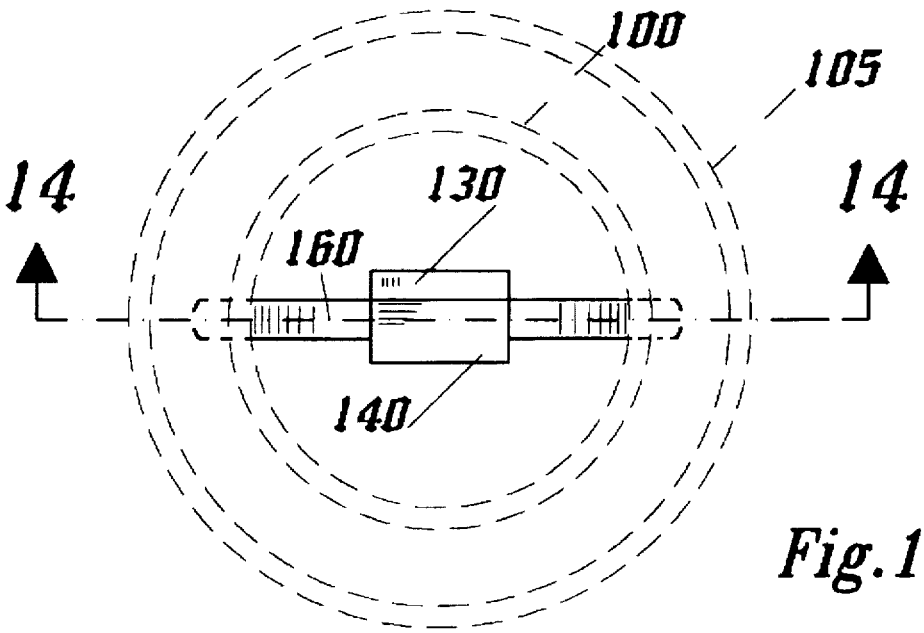
FIG. 13 is a top plan view showing the jet steering diverter nozzle in phantom, and top plan view of the second embodiment of the security device of the present invention.
Figure 15:
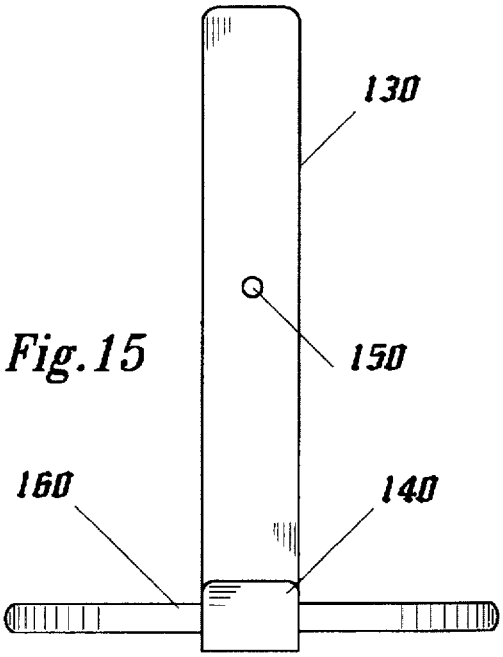
FIG. 15 is a front elevational view of a cover holding member of the second embodiment of the present invention.
Figure 16:
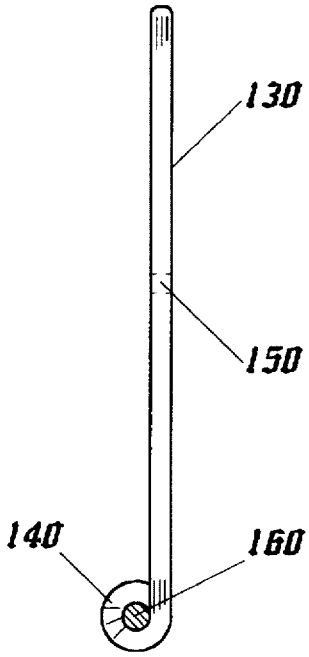
FIG. 16 is a side elevational view of the cover holding member of the second embodiment of the present invention.

In another embodiment of the present invention, shown in FIGS. 10–19, a cover holding member 130 at its top end has a locking opening 150 to accept the cover locking member 200 and at its bottom end has a latching flange lip 140 substantially in the shape of an inverted U (as shown in FIGS. 11, 15 and 16). However, the latching flange lip 140 in this embodiment has an additional element, an elongated pivot pin 160 protruding laterally through the cover holding member latching flange lip 140 and extending outwardly, to compensate for the lacking of water separator 110 in this model of the jet separator diverter nozzle 100. The cover holding member 130 is specifically equipped with the pivot pin 160 and structured to lock the pivot pin 160 in any conventionally known jet steering diverter nozzle 100, not equipped with the water separator 110. The cover holding member 130 is closedly secured around the pivot pin 160, preferably by welding, thus forming an assembly in the shape of an inverted T.

The pivot pin 160 has to be longer than some of the inside cross-sectional diameters of the cylindrical inner surface of the jet steering diverter nozzle 100, as shown in FIG. 14. The pivot pin 160 is structured to engage the inside surface of the jet steering diverter nozzle 100 or the inside wall of the pivotable mounting boss 105 of the jet steering diverter nozzle 100, thus acting as a stopper for the cover holding member 130 element when the pivot pin 160 is transversely received within.

FIG. 14 shows the manner in which the second embodiment of the present invention is mounted inside the jet steering diverter nozzle 100. When the cover holding member 130 is inserted inside the jet steering diverter nozzle 100, the pivot pin 160 is tipped, slided and fitted into the pivotable mounting boss 105 of the jet steering diverter nozzle 100, which then supports transversely disposed pivot pin 160 in place. Because the jet steering diverter nozzle 100 widens in the direction towards the pivotable mounting boss 105, as stated above, the cover holding member 130 can be easily moved into place and the pivot pin 160 is easily secured inside the inner wall in the pivotable mounting boss 105 of the jet steering diverter nozzle 100. It is securely kept in the operable position within said pivotable mounting boss 105 until removal, when it is easily tipped over and slidedly removed from the jet steering diverter nozzle 100. The nozzle cover 120 is secured through the locking opening 150 in the cover holding member 130, by means of the cover locking member 200, as shown in FIG. 1.

Figure 19:
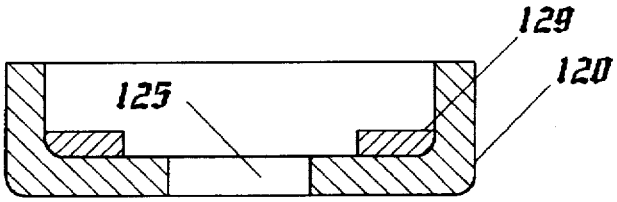
FIG. 19 is a cross-sectional view taken along line 19—19 of FIG. 18.
Figure 17:
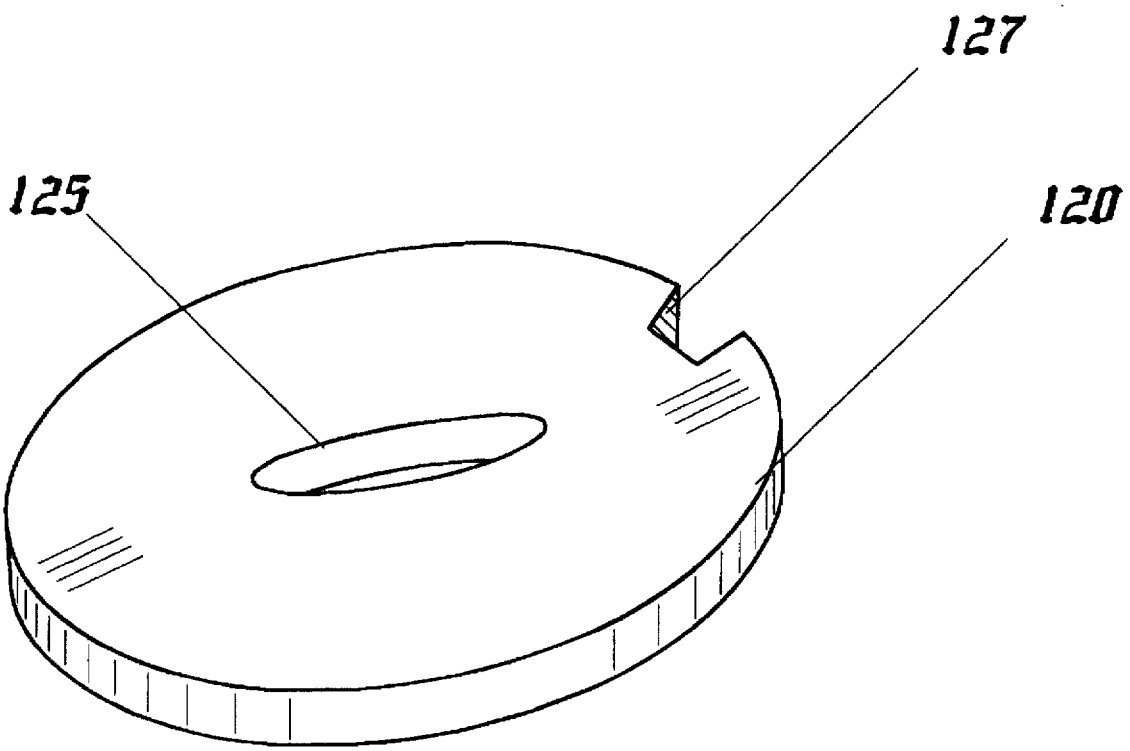
FIG. 17 is a perspective view of a nozzle cover element of the second embodiment of the present invention.

The nozzle cover 120 in the second embodiment of the present invention has a side recess 127 necessary in some models of the conventional jet steering diverter nozzle 100 in order to accomodate a steering component. In this embodiment as shown in FIGS. 17–19, a seal member 129, if placed at the periphery of the circular undersurface of the nozzle cover 120, has to be cut in order to match the side recess 129 of the nozzle cover 120.

Preferably, the security device nozzle cover 120 and the cover holding member 130 are made of a relatively lightweight, but stiff and extremely durable material so that they can easily be lifted for installation within the jet steering diverter nozzle 100 and removal therefrom. In the preferred embodiment, suitable metal like stamped aluminum or anodized Billet aluminum #6061-T6 or even plastic composite is utilized for the nozzle cover 120 and stainless steel #314 is utilized for the cover holding member 130. Additionally, the security device nozzle cover 120, the cover holding member 130 and the cover locking member 200 should be made of a material which is suited for underwater or marine applications.

It will be appreciated that alternate methods and means accomplishing functionally similar adaptations are considered equivalents. Other means of connecting the nozzle cover and the cover holding member to the jet steering diverter nozzle are possible, depending on the characteristics and design of the watercraft jet steering diverter nozzle. The design of the watercraft jet steering diverter nozzle, which receivably accepts the cover holding member of the security device, dictates whether the bottom of the cover holding member should be fitted into the pivotable mounting boss or whether the cover holding member should be designed with the flange lip in order to catch and hold onto a water separator or another element within the jet steering diverter nozzle.

Several modifications of the present invention may become readily apparent to those skilled in the art in light of the foregoing disclosure. Therefore, the scope of the present invention should be interpreted solely from the following claims, as such claims are read in light of the disclosure.

What is claimed is:

1. An anti-theft device for mounting on a watercraft jet pump steering diverter nozzle, said steering diverter nozzle having an entrance end, an exit end, a generally cylindrical inner surface flaring outwardly from the exit end to the entrance end, a horizontal axis, and a pivotable mounting boss attached at the entrance end, wherein the pivotable mounting boss having larger inside cross-sectional diameter than any inside cross-sectional diameter of the inner surface of the steering diverter nozzle, said anti-theft device comprising:

cover means adapted to be attached to the exit end of the jet pump steering diverter nozzle;

at least one cover engaging means for engaging in tight contact said cover means to the jet pump steering diverter nozzle, whereby preventing movement of said cover means in order to restrict the flow of water passing through the jet pump steering diverter nozzle; and where at least one of said at least one cover engaging means is adapted to extend from said cover means and through the exit end into engagement with the inner surface of the jet pump steering diverter nozzle.

2. The anti-theft device according to claim 1, wherein said at least one cover engaging means comprises at least one cover holding means for joining said cover means at approximately right angle for supporting said cover means in a vertical orientation, wherein said at least one cover holding means being generally horizontal.

3. The anti-theft device according to claim 2, wherein said at least one cover holding means when attached to said cover means, is adapted to extend from said cover means into engagement with the inner surface of the jet pump steering diverter nozzle and adapted to be directed toward said pivotable mounting boss of the jet pump steering diverter nozzle.

4. The anti-theft device according to claim 3, wherein said at least one cover engaging means is a cover locking means for keeping the cover means engaged with the jet pump steering diverter nozzle.

5. The anti-theft device according to claim 4, wherein said at least one cover holding means is elongated and having a top end, a bottom end, a locking opening at a predetermined length from the top end of said at least one cover holding means for insertion and attachment of said cover locking means, and a latching means at the bottom end of said at least one cover holding means, wherein said latching means is outwardly extended for communicating with the jet pump steering diverter nozzle, whereby latching said cover means onto the jet pump steering diverter nozzle when said at least one cover holding means is extended from said cover means and said cover locking means is locked.

6. An anti-theft device for mounting on a watercraft jet pump steering diverter nozzle, said steering diverter nozzle having an entrance end, an exit end a generally cylindrical inner surface flaring outwardly from the exit end to the entrance end, a horizontal axis, and a pivotable mounting boss attached at the entrance end, wherein the pivotable mounting boss having larger inside cross-sectional diameter than any inside cross-sectional diameter of the inner surface of the steering diverter nozzle, said anti-theft device comprising:

cover means having a through-opening and an undersurface, adapted to be attached to the exit end of the jet pump steering diverter nozzle; and at least one cover engaging means adapted to extend through the exit end for engaging in tight contact said cover means to the jet pump steering diverter nozzle, whereby preventing movement of said cover means in order to restrict the flow of water passing through the jet pump steering diverter nozzle.

7. The anti-theft device according to claim 6, wherein said at least one cover engaging means comprises a cover holding means joining said cover means at approximately right angle for supporting said cover means in a vertical orientation, wherein said cover holding means being generally horizontal.

8. The anti-theft device according to claim 7, wherein said cover holding means, when attached to said cover means, is adapted to extend through said through-opening of said cover means into engagement with the inner surface of the jet pump steering diverter nozzle and adapted to be directed toward said pivotable mounting boss of the jet pump steering diverter nozzle.

9. The anti-theft device according to claim 8, wherein said at least one cover engaging means comprises a cover locking means for cooperatively engaging said cover means with the jet pump steering diverter nozzle, for holding said cover means in a vertically adjusted position, and for preventing movement of said cover means around the jet pump steering diverter nozzle, wherein said cover holding means being generally horizontal.

10. The anti-theft device according to claim 9, wherein said cover holding means is elongated and having a top end, a bottom end, a locking opening at a predetermined length from the top end of said cover holding means for insertion and attachment of said cover locking means, and a latching means at the bottom end of said cover holding means, formed for communicating with the jet pump steering diverter nozzle, whereby latching said cover means onto the jet pump steering diverter nozzle when said cover holding means is extended through said through-opening of said cover means and said cover locking means is locked.

11. The anti-theft device according to claim 10, wherein said latching means of said cover holding means comprises an elongated pin and an upwardly-curved flange lip adapted for engaging said elongated pin which is fixedly inserted within said flange lip, said elongated pin extending outwardly at the bottom end of said cover holding means and having a length which is larger than some inside cross-sectional diameters of the jet pump steering diverter nozzle, said elongated pin adapted to be transversely received within the inner surface of the jet pump steering diverter nozzle or within said pivotable mounting boss for staying engaged within until removed by slanting, whereby latching said cover means onto the jet pump steering diverter nozzle when said cover holding means is extended through said through-opening of said cover means and said cover locking means is secured through said locking opening of said cover holding means.

12. The anti-theft device according to claim 11 wherein said cover means further comprises a seal member surrounding the periphery of the undersurface of said cover means, whereby said seal member is adapted to be in tight contact with the exit end of the jet pump steering diverter nozzle when said cover means is mounted thereon.

13. The anti-theft device according to claim 12, wherein said cover locking means is a padlock.

14. The anti-theft device according to claim 1, wherein said cover means comprises at least one peripheral recess formed in said cover means for accepting a steering component which is in some models of the jet pump steering diverter nozzle placed within.

15. The anti-theft device according to claim 10, for models of the jet pump steering diverter nozzle having a water separator positioned inside the jet pump steering diverter nozzle and bisecting the radial plane of the jet pump steering diverter nozzle, wherein said latching means of said cover holding means comprises an upwardly projecting curved flange lip adapted for engaging said water separator positioned inside the jet pump steering diverter nozzle, whereby latching said cover means onto the jet pump steering diverter nozzle when said cover holding means is extended through said through-opening of said cover means and said cover locking means is secured through said locking opening of said cover holding means.

16. The anti-theft device according to claim 15 wherein said cover means further comprises a seal member surrounding the periphery of the undersurface of said cover means, whereby said seal member is adapted for tight contact with the exit end of the jet pump steering diverter nozzle when the cover means is mounted thereon.

17. The anti-theft device according to claim 16, wherein said cover locking means is a padlock.

18. The anti-theft device according to claim 15 wherein said cover means comprises at least one peripheral recess formed in said cover means for accepting a steering component which is in some models of the jet pump steering diverter nozzle placed within.

19. A method for preventing theft of a personal watercraft by locking a jet pump steering diverter nozzle having an entrance and an exit end, comprising the steps of:

(a) mounting cover means to the exit end of the jet pump steering diverter nozzle;

(b) engaging said cover means in tight contact with the jet pump steering diverter nozzle by extending a cover holding means through the exit end, whereby preventing movement of said cover means in order to restrict the flow of water passing through the jet pump steering diverter nozzle; and (c) locking said cover means to prevent unauthorized removal thereof.

* * * * *